US008970648B2

(12) United States Patent
Iguchi

(10) Patent No.: US 8,970,648 B2
(45) Date of Patent: Mar. 3, 2015

(54) ERASING APPARATUS AND DECOLORING METHOD

(71) Applicant: Toshiba Tec Kabushiki Kaisha, Tokyo (JP)

(72) Inventor: Ken Iguchi, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 43 days.

(21) Appl. No.: 13/791,507

(22) Filed: Mar. 8, 2013

(65) Prior Publication Data

US 2013/0242024 A1 Sep. 19, 2013

Related U.S. Application Data

(60) Provisional application No. 61/612,238, filed on Mar. 16, 2012.

(51) Int. Cl.

| | |
|---|---|
| ***B41J 29/16*** | (2006.01) |
| ***B41J 2/38*** | (2006.01) |
| ***B41J 2/32*** | (2006.01) |

(52) U.S. Cl.

CPC .... *B41J 2/38* (2013.01); *B41J 2/32* (2013.01); *B41J 2202/37* (2013.01)

USPC ..... 347/179

(58) Field of Classification Search

USPC ..... 347/171, 179, 222

See application file for complete search history.

(56) References Cited

U.S. PATENT DOCUMENTS

2005/0285923 A1* 12/2005 Preszler et al. ..... 347/171

FOREIGN PATENT DOCUMENTS

| | | |
|---|---|---|
| JP | 06-161312 | 6/1994 |
| JP | 07-032624 | 2/1995 |
| JP | 11-065359 | 3/1999 |

OTHER PUBLICATIONS

U.S. Appl. No. 13/534,994, Ken Iguchi et al., filed Jun. 27, 2012, 35 pages.

U.S. Appl. No. 13/484,195, Takahiro Kawaguchi et al., filed May 30, 2012, 50 pages.

* cited by examiner

*Primary Examiner* — Kristal Feggins

(74) *Attorney, Agent, or Firm* — Patterson & Sheridan LLP

(57) ABSTRACT

According to one embodiment, an erasing apparatus comprises a conveying unit that transports a sheet on which a color is developed by a developing material and a decoloring unit that comprises a heating unit that heats up the sheet to decolor the color. The heating unit has a variable heat quantity output to enable rapid warm up of the apparatus, but reduce energy waste during decoloring.

18 Claims, 4 Drawing Sheets

ERASING APPARATUS AND DECOLORING METHOD

CROSS-REFERENCE TO RELATED APPLICATION

This application is based upon and claims the benefit of priority from U.S. Provisional Patent Application No. 61/612,238, filed on Mar. 16, 2012; the entire contents of which are incorporated herein by reference.

FIELD

Embodiments described herein relate generally to an decoloring apparatus that renders un-colored the color of an image created using a developing material, i.e., a coloring material.

BACKGROUND

The decoloring apparatus carries out erasing of the color of the coloring material (developing material) so as to erase the color of the image and to enable reuse of the paper sheet on which the coloring material has been formed.

To erase an image, the decoloring apparatus heats the developed coloring material (developing material) so as to decrease the effect of the developing agent on the coloring compound (the precursor compound of the coloring matter) that causes display of the color under the action of the developing agent. As a result, the coloring state is cancelled. As used herein, color includes a material having a reflected wavelength, when received by the human eye, within the range of wavelengths discernible by the eye as a color, as well as black and white (when formed on a non-white back ground).

However, when the thermal capacity of a decoloring apparatus is increased to shorten the warm-up time thereof, the power consumption increases during the decoloring process, because the decoloring process may not require the higher thermal capacity function, resulting heat loss, and thus energy loss, resulting from operating the apparatus at a higher than necessary temperature. On the other hand, where a decoloring apparatus merely has the thermal capability required to maintain the temperature required for the decoloring process, the warm-up time of the apparatus will be too long.

DETAILED DESCRIPTION

Embodiments solve the aforementioned problems of the related art by providing an erasing apparatus and a decoloring method for decoloring the color of the image with a shorter warm-up time less power consumption.

In general, embodiments will be explained with reference to the drawings.

According to an embodiment, an erasing apparatus comprises a conveying unit that transports a sheet on which a color is developed by a developing material and a decoloring unit that comprises a heating unit that heats up the sheet to decolor (render non-visible) the color. The heat output from the heating unit is variable.

Figure 1:
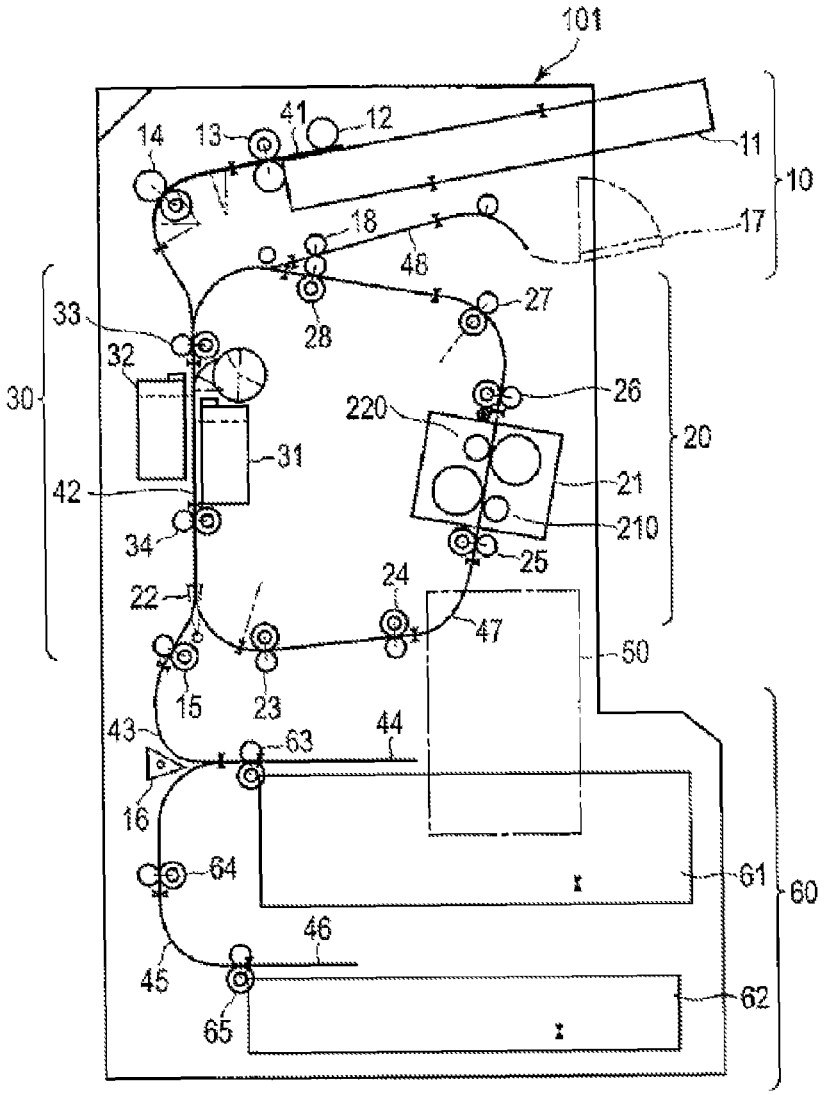
FIG. 1 is a diagram illustrating an example of an erasing apparatus according to an embodiment.
Figure 2:
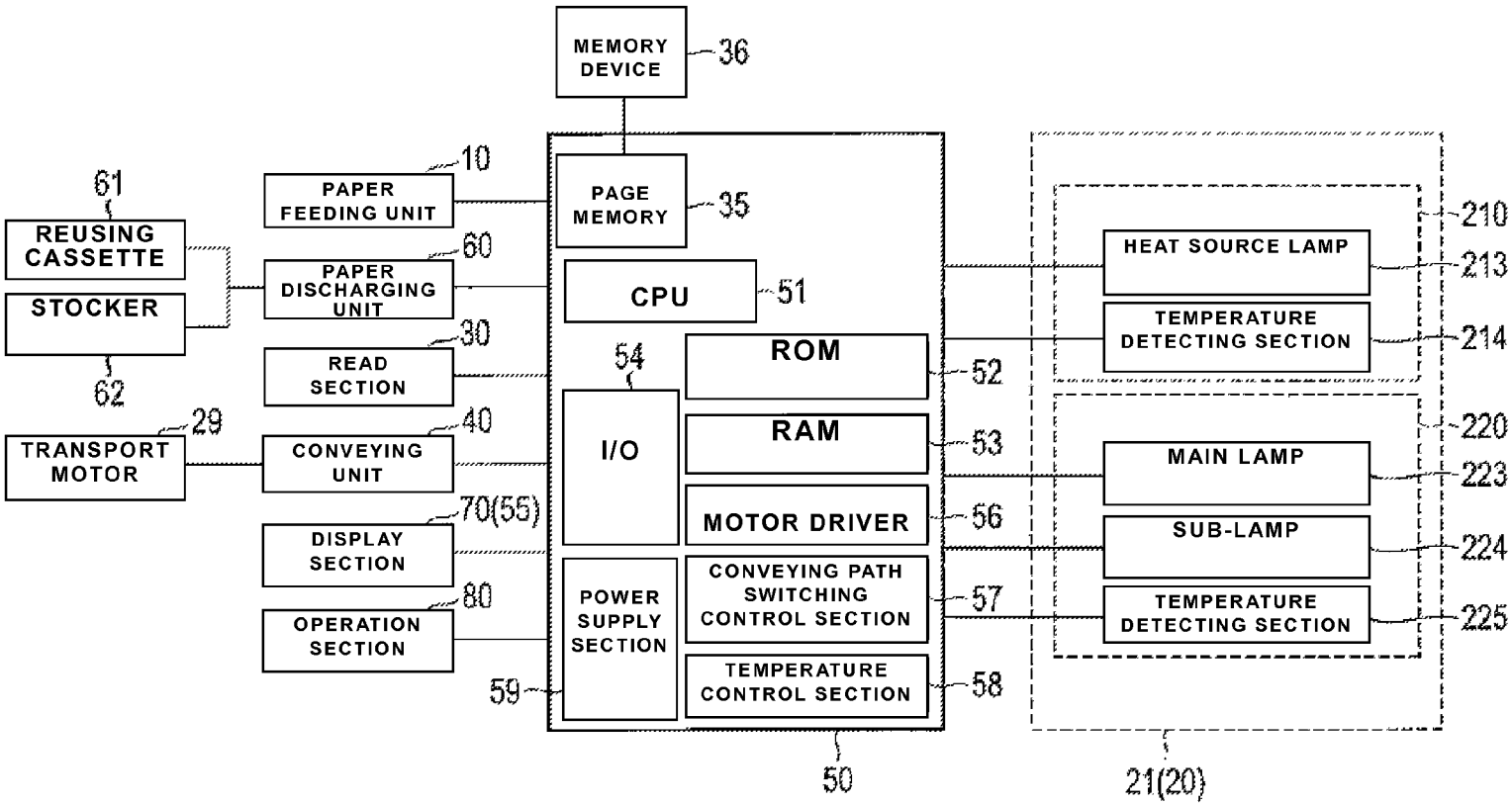
FIG. 2 is a diagram illustrating an example of a main portion of the erasing apparatus according to the embodiment.

As shown in FIGS. 1 and 2, an erasing apparatus 101 at least includes a paper feeding unit 10, an erasing section 20, a read section 30, a conveying unit 40 (not shown in FIG. 1), a decoloring device control section 50, and a paper discharging unit 60. The erasing apparatus 101 also contains a display section 70 and an operation section 80, as shown in FIG. 2. Here, for example, the display section 70 and the operation section 80 may be formed monolithically by using, e.g., a touch panel, etc. FIG. 1 is a schematic diagram of the erasing apparatus 101, illustrating mainly the transportation of sheets (paper sheets) in the erasing apparatus 101 and specifically the circulation of the sheets to a decoloring device 21 disposed at the erasing section 20. FIG. 2 is a block diagram illustrating the erasing apparatus 101 shown with its major blocks.

The paper feeding unit 10 at least includes a section 11 for holding the sheets before decoloration (hereinafter, a feed paper cassette), a conveying path 41 (conveying unit 40), a feed paper roller 12, a conveying roller 13, and a conveying roller 14. The feed paper cassette 11 holds the sheet (paper sheet) that has an image (coloring material), which is the object of the decoloration operation. Thus, the sheet that has not yet been decolored is stored at the feed paper cassette 11. The conveying path 41 (included in conveying unit 40 in FIG. 2) is formed to guide the still colored sheet held in the feed paper cassette 11 to the erasing section 20. The feed paper roller 12 applies a pushing force (transporting force) on the still decolored sheet so that the sheet can be transported (driven to move) to the conveying path 41.

The conveying path 41 is connected to a conveying path 42 (included in conveying unit 40 in FIG. 2), which is formed in the read section 30.

The conveying path 42 (conveying unit 40) is formed to guide the still colored sheet to the erasing section 20. At the erasing section 20, the color of the image on the sheet is erased (i.e., the color of the coloring material is decolored to be invisible or substantially invisible to the human eye). The sheet (discolored sheet) is guided to the paper discharging unit 60. Along the conveying path 42, at least conveying rollers 33 and 34 are provided, and the conveying rollers 33 and 34 apply a pushing force on the pre-discolored sheet and the decolored sheet so that these sheets can be transported through the conveying path 42.

The erasing section 20 at least includes a decoloring device 21, a branching unit 22, a conveying path 47 (included in conveying unit 40 in FIG. 2), and conveying rollers 23 through 28. The branching unit 22 faces a decoloring device 21 and branches a still-discolored sheet from the conveying path 42 based on the reading result by the read section 30 that the sheet contains an image thereon and directs it to the conveying path 47. The conveying path 47 guides the pre-discolored sheet to the decoloring device 21. The conveying rollers 23 through 25 provide a pushing force on the still-discolored sheet so that it can be transported to the decoloring device 21. The conveying rollers 26 through 28 guide the sheet decolored or "erased" at the decoloring device 21 back to the conveying path 42.

The decoloring device 21 contains a first heating unit 210 and a second heating unit 220. Both of the first heating unit 210 and the second heating unit 220 may apply heat at a decoloring temperature, which is over a prescribed temperature to decolor or erase the image, on the sheet passing through prescribed nip regions. The prescribed nip region is a portion formed between a pair of rollers that are included in a single heating unit (210 or 220).

The decoloring device 21 will be explained in detail later with reference to FIG. 3.

The read section 30 (FIG. 1) includes at least a first image sensor 31 (FIG. 1) and a second image sensor 32 (FIG. 1), both of which detect whether the sheet that passes through the conveying path 42 needs to be decolored, i.e., whether the sheet has an image thereon. The first image sensor 31 and the second image sensor 32 may be made of, e.g., reflective density sensors or dielectric constant measurement sensors, etc., and they detect the images on both surfaces of the sheet that passes through the conveying path 42.

The first image sensor 31 and the second image sensor 32 of the read section 30 may be CMOS sensors, for example, and they may acquire the image information of the sheet that passes through the conveying path 42. The image information acquired by the first and the second image sensors 31 and 32 is stored in a memory device 36, as shown in FIG. 2. The image information stored in the memory device 36 is subject to A-D conversion (analog/digital conversion), and the converted information is sent to a page memory 35 in page unit.

The conveying path 42 is connected to a conveying path 43 at the branching unit 22 that guides a decolored sheet selected by the branching unit 22 to the paper discharging unit 60.

Along the conveying path 43 (included in the conveying unit 40 in FIG. 2), at least a discharged paper branching unit 16 and a conveying roller 15 are disposed. The discharged paper branching unit 16 branches the decolored sheet branched by the branching unit 22 to either a first decolored sheet holding section (hereinafter a reusing cassette) 61 or a second decolored sheet holding section (hereinafter a stocker) 62 of the paper discharging unit 60. The decolored sheet that is branched toward the reusing cassette 61 is guided by a conveying roller 63 that is disposed along a conveying path 44 (included in the conveying unit 40 in FIG. 2). Also, the decolored sheet that is branched toward the stocker 62 is guided by the conveying rollers 64 and 65 and conveying paths 45 and 46 (both are included in the conveying unit 40 in FIG. 2).

In addition, a structure to manually feed a pre-discolored sheet to the decoloring device 21 is provided. The structure included a manual paper feeding unit 17 and a conveying roller 18 that is disposed along a manual feeding conveying path 48. A pre-discolored sheet fed from the manual paper feeding unit 17 passes through the manual feeding conveying path 48 and is guided to the conveying path 42 by the conveying roller 18. Thus, this pre-discolored sheet does not pass through the conveying path 41.

The control section 50 includes at least a Central Processing Unit (CPU) (or principal controller) 51, a Read-Only Memory (ROM) 52, a Random Access Memory (RAM) 53, an input/output (I/O) port 54, a motor driver 56, a conveying path switching control section (branching unit drive section) 57, a temperature control section 58, a power supply section 59, etc. Here, the operation section 80 and the display section 70 are connected to the control section 50. Also, the motor driver 56 drives a transport motor 29 that drives the conveying rollers 23 through 28 located at the upstream or the downstream of the decoloring device 21 and drives any other motors that drive the other rollers, for example.

The principal controller (CPU) 51 controls the operations of the various sections according to operation programs stored in the ROM 52.

The ROM 52 stores the operation programs for the operation of the decoloring device 21, as well as the reference data that are used to compare with the detection results detected by the first and the second image sensors 31 and 32, etc.

The RAM 53 receives and stores the data input through the I/O port 54, such as the detection results of the first and the second image sensors 31 and 32, the inputs from JAM sensors that are disposed at prescribed positions along the conveying paths 41 through 48, as well as the temporary data for executing the processing routine according to the instruction input (operation information) from the operation section 80.

For example, the I/O port 54 converts the detection results of the first and the second image sensors 31 and 32 to a format that can be processed by the CPU (principal control section) 51. The I/O port 54 also converts the instruction input from the operation section 80 to a format that can be processed by the CPU 51. The I/O port 54 also works to receive the information related to the paper feeding unit 10, the erasing section 20, the read section 30, the conveying unit 40, and the paper discharging unit 60, e.g., the control instructions to the motors and the branching unit and the detected data of any sensors, etc.

In the paper discharging unit 60, the decolored sheet, going through the conveying path 43 as shown in FIG. 1, is guided by the discharged paper branching unit 16 to either the reusing cassette (first decolored sheet holding section) 61 or the stocker (second decolored sheet holding section) 62.

The operation section 80 receives the control instruction from input, e.g., the user, and outputs a control command corresponding to the control instruction in a format readable by the CPU 51.

As shown in FIG. 1, the decoloring device 21 is located at a prescribed position along the conveying path (a second conveying path) 47. The conveying path 47 branches just after the read section 30 (conveying path 42) from the first conveying path, and is comprised of the conveying path 41, the conveying path 42 (read section 30), the conveying path 43, the conveying path 44 (paper discharging unit 60), the conveying paths 45 and 46 that are located between [the portion and] the reusing cassette 61 and the stocker 62.

Figure 3:
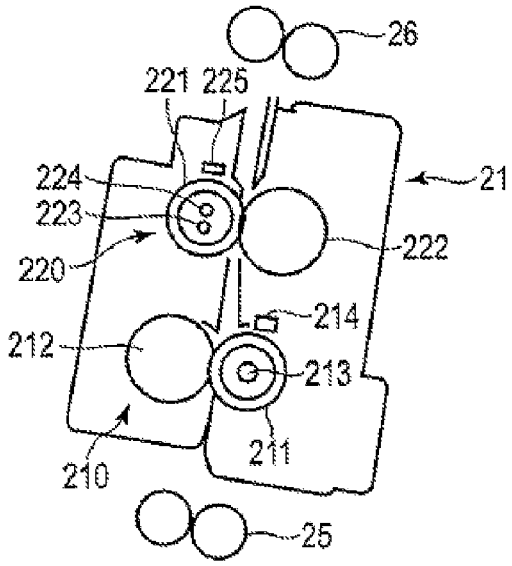
FIG. 3 is a diagram illustrating an example of the decoloring device of the erasing apparatus according to the embodiment.

As shown in FIG. 3, the decoloring device 21 includes the first heating unit 210 and the second heating unit 220. The side or location of the conveying rollers 23, 24, and 25 of the conveying path 47 with respect to decoloring device is defined as the transporting upstream side. On the other hand, the side of the conveying rollers 26, 27, and 28 of the conveying path 47 with respect to decoloring device is defined as the transporting downstream side.

The first heating unit 210 is disposed close to the transporting upstream side and includes a pair of rollers, i.e., a heating roller 211 and a pressing roller 212. A heat source lamp 213 is disposed inside the heating roller 211, and a temperature detecting section 214 is disposed adjacent the outer periphery of the heating roller 211.

The second heating unit 220 is spaced from the first heating unit 210 and is disposed close to the transporting downstream side and includes a pair of rollers, i.e., a heating roller 221 and a pressing roller 222. A first heat source lamp (hereinafter a main lamp) 223 and a second heat source lamp (hereinafter a sub-lamp) 224 are disposed inside the heating roller 221, and a temperature detecting section 225 is disposed adjacent to the outer periphery of the heating roller 221.

The thermal capacity of the heat source lamp 213 is nearly equal to the sum of the thermal capacities of the main lamp 223 and sub-lamp 224. The thermal capacity of the main lamp 223 and that of the sub-lamp 224 are nearly equal to each other.

The heating rollers 211 and 221 are disposed so that both sides of the sheet passing through the heating rollers 211 and 221 contact with the heating rollers 211 and 221. In the configuration of the embodiment, the heating roller 211 is in contact with one surface (outer periphery, or the second image sensor 32 side) of the sheet passing through the second conveying path. Consequently, the heating roller 221 is in contact with the other surface (inner periphery, or the first image sensor 31 side) of the sheet passing through the second conveying path.

The first heating unit 210 and/or the second heating unit 220 each may have a nip formed from a roller and an endless belt. The heat source lamp 213 of the first heating unit 210 or the main lamp 223 and sub-lamp 224 of the second heating unit 220 may be IH (inductive heating) heaters that generate inductive heat by the metal surface of the heating roller (or the metal layer of the belt) for example.

In the following, the transporting operation will be explained.

Figure 4:
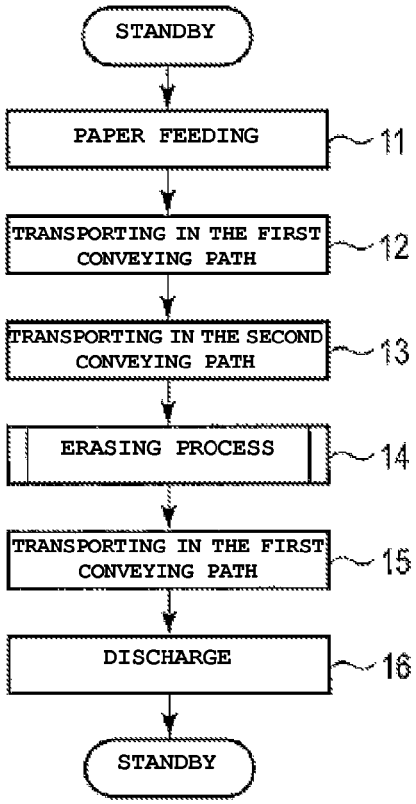
FIG. 4 is a diagram illustrating an example of an operation in the decoloring process of the erasing apparatus according to the embodiment.

In a decoloring and read mode, the pre-discolored sheet, which is a sheet on which the coloring material is developed, is fed from the paper feeding unit 10 through the first conveying path [11], as shown in FIG. 4. Then, the sheet is positioned at the read section 30 [12]. At the read section 30, the first and the second image sensors 31 and 32 read image information on the sheet from both sides. The image information on the sheet read by the first and the second image sensors 31 and 32 is then stored at the memory device 36.

After passing through the read section 30, the sheet is guided through the second conveying path (conveying path 47) to the decoloring device 21 [13]. Then, the sheet is subject to the decoloring process to decolor the color of the image [14]. During the decoloring process, the sheet passes the conveying roller 25 disposed on the transporting upstream side and then goes between the two rollers of the first heating unit 210 and then between the two rollers of the second heating unit 220 disposed on the transporting downstream side.

The sheet that has been decolored by the decoloring device 21 is guided by the conveying roller 26 disposed on the transporting downstream side through the second conveying path [15]. The decolored sheet in the second conveying path is once again guided to the first conveying path and discharged to the reusing cassette (a first discharged paper tray) 61 or the stocker (a second discharged paper tray) 62 of the paper discharging unit 60.

Here, when the decoloring process is carried out by the decoloring device 21, the second heating unit 220 (i.e., the heat source section on the transporting downstream side) conducts the decoloring process on a sheet that has been already heated by the first heating unit 210 (i.e., the heat source section on the transporting upstream side). Consequently, the heat that the second heating unit 220 is required to provide to the sheet is lower than the heat that the first heating unit 210 is required to provide to the sheet. Thus, the heat quantity needed to carry out the decoloring process at the second heating unit 220 is smaller. On the other hand, if the second heating unit 220 discharges the same amount of heat as the first heating unit 210, the excessive heat by the second heating unit 220 results in waste of energy resulting in non-recovered cost.

On the other hand, the second heat unit 220 is preferred to have a larger thermal capacity when the decoloring device 21 is in a warm-up process, to rapidly heat the decoloring device. Thus, if the second heating unit 220 is a heat source section with a lower thermal capacity, the time needed for the heating roller 221 to reach the decolorable temperature may become longer. Here, the warm-up process refers to the process executed for the heat source section 221 (heating roller) to reach the decolorable temperature.

Figure 5:
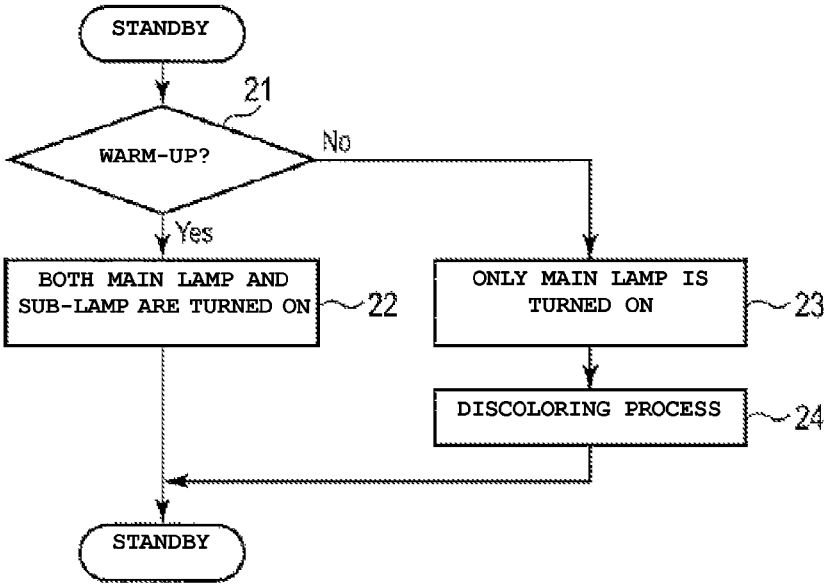
FIG. 5 is a diagram illustrating an example of an operation of the decoloring process of the erasing apparatus according to the embodiment.

To save heat during the decoloring process and to save warm-up time during the warm-up process, the heat source of the heat source section on the transporting downstream side (i.e., the second heating unit 220) is configured to have two lamps, that is, the main lamp 223 and the sub-lamp 224. As shown in FIG. 5, in a warm-up mode [21—YES], both the main lamp 223 and the sub-lamp 224 are turned on, so that the temperature of the heat source section (heating roller) 221 can quickly reach the decolorable temperature [22].

On the other hand, when decoloring process is carried out for the color of the image on the sheet [21—NO], only the main lamp 223 of the second heating unit 220 is turned on [23], and the decoloring process is carried out [24].

Figure 6:
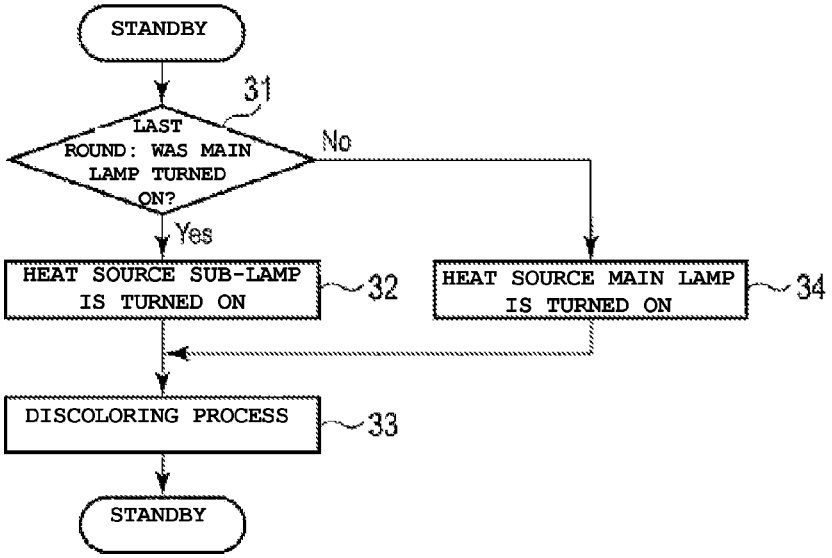
FIG. 6 is diagram illustrating an example of an operation of the decoloring process of the erasing apparatus according to the embodiment.

FIG. 6 is a diagram illustrating another example of control of the lamps (heat sources) adopted in the decoloring process, in which either the main lamp 223 or the sub-lamp 224 alone is turned on.

If either the main lamp 223 or the sub-lamp 224 alone is turned on to carry out the decoloring process, the lamps will soon run over the warranty time (lifetime) because only one lamp is turned on. In order to replace the run-out lamp, the entire second heating unit 220 may need to be replaced.

Consequently, it is preferred to turn on the lamp different from the lamp that was turned on in the last round of the decoloring process. However, because lamp life is at least in part a function of the number of times the lamp is switched on and off, it is preferred to use the same lamp so long as a series of sheets is present and ready to be decolored.

For example, if the lamp that was turned on in the decoloring process in the last round (the preceding round) is the main lamp 223 [31—YES], the sub-lamp 224 is turned on in the next round (the following round) of decoloring process [32], and the decoloring process is carried out [33]. A round is considered a period where decoloring is occurring and at least one sheet is present in the input of the system for analysis and decoloration if appropriate.

Also, if the lamp that was turned on in the last round of decoloring process is the sub-lamp 224 [31—NO], the main lamp 223 is turned on [34] in the next round (the following round) of decoloring process, and the decoloring process is carried out [33].

In the control operation as shown in FIG. 6, the lamp to be turned on may be switched in each round of the decoloring process. However, it takes a certain time to heat up a non-heated roller to the decolorable temperature, because the efficiency for heating up the lamp from the cold state to the hot state is poor. Consequently, as long as a pre-discolored sheet is prepared at the feed paper cassette or the manual paper feeding unit 17, the same lamp is preferred to be used (turned on). Thus, even when the sheets for decoloration are one sheet for a job, the same lamp is preferred to be kept ON (in use) if there is the next sheet to feed (paper feeding). Therefore, switching of the heat source lamp that is turned on is preferably not carried out.

With the above-mentioned configuration, the optimum heat quantity can be applied to the sheet or the coloring material as the decoloration object, and it is possible to prevent degradation in performance and increase in power consumption.

Also, it is possible to prolong the lifetime of the device.

Though the erasing apparatus shown in FIGS. 1 to 3 has the reading section 30 to select the sheets to be decolored, the read section 30 may be omitted. In this case, decoloration is carried out for all of the sheets that have been fed into the erasing apparatus regardless of whether the have an image thereon.

According to the embodiment, the decoloring apparatus can avoid shortening of the lifetime of the apparatus (heat source lamps), can shorten the warm-up time, and can cut the cost of the apparatus and the power consumption.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An erasing apparatus comprising:

a conveying unit that transports a sheet on which a color is developed by a developing material; and a decoloring unit that comprises a heating unit that is configured to heat the sheet to decolor the color, wherein the heat quantity output by the heating unit is variable, and wherein the heating unit is configured so that the heat quantity output during warming up of the heating unit is larger than the heat quantity output during decoloring of the sheet.

2. The erasing apparatus according to claim 1, wherein the decoloring unit comprises a first heating unit and a second heating unit that is disposed downstream of the first heating unit, and the second heating unit is configured for variable heat output.

3. The erasing apparatus according to claim 2, wherein the first heating unit is disposed to receive the sheet from the conveying unit, and the second heating unit is disposed to receive the sheet that passed through the first heating unit.

4. The erasing apparatus according to claim 2, wherein the total heat quantity output of the second heating unit is equal or smaller than the total heat quantity output of the first heating unit.

5. The erasing apparatus according to claim 2, wherein the second heating unit is disposed to apply heat from an opposite side of the sheet relative to a side of the sheet to which the first heating unit applies heat.

6. The erasing apparatus according to claim 1, wherein the heating unit comprises two or more heat sources.

7. The erasing apparatus according to claim 6, wherein the heat quantity output of the heat sources are the same.

8. The erasing apparatus according to claim 6, wherein all of the heat sources are energized during warming up of the heating units.

9. The erasing apparatus according to claim 6, wherein at least one of the heat sources is turned off during decoloring of the sheet.

10. A method of decoloring a sheet on which a color is developed by a developing material, using a first heating unit and a second heating unit that is disposed downstream of the first heating unit, the method comprising:

warming up the first and the second heating units by turning on the first and the second heating units; and decoloring the sheet by turning on the first and the second heating units, wherein a heat quantity output of the second heating unit during the warming up of the second heating unit is larger than a heat quantity output of the second heating unit during the decoloring of the sheet.

11. The decoloring method according to claim 10, wherein the total heat quantity output of the second heating unit is equal to or smaller than the total heat quantity output of the first heating unit.

12. The decoloring method according to claim 10, wherein the second heating unit comprises a first heat source and a second heat source, and only one of the heat source is turned on during the decoloring of the sheet.

13. The decoloring method according to claim 12, wherein all of the heat sources are turned on during the warming up of the second heat unit.

14. The decoloring method according to claim 12, wherein different ones of the heat sources is turned on between a first time that is before the warming up of the erasing apparatus and a second time that is after the warming up of the erasing apparatus.

15. An erasing apparatus comprising:

a conveying unit that transports a sheet on which a color is developed by a developing material; and a decoloring unit that comprises a plurality of heating units that heat the sheet to decolor the color, wherein the heating units include a first heating unit and a second heating unit that is disposed downstream of the first heating unit and has a variable heat quantity output, and the heat quantity output of the second heating unit while the heating units are being warmed up is larger than the heat quantity output of the second heating unit while the sheet is being decolored.

16. The erasing apparatus according to claim 15, wherein the total heat quantity output of the second heating unit is equal to or smaller than the total heat quantity output of the first heating unit.

17. The erasing apparatus according to claim 16, wherein the second heating unit comprises a first heat source and a second heat source, and is configured to turn on only one of the heat sources while the sheet is being decolored.

18. The erasing apparatus according to claim 17, wherein the second heating unit is configured to turn on different one of the heat sources between a first time that is before the heating units are being warmed up and after a second time that is after the heating units have been warmed up.

* * * * *